US008752870B2

(12) United States Patent
Wolf

(10) Patent No.: US 8,752,870 B2
(45) Date of Patent: Jun. 17, 2014

(54) REMOTE-CONTROLLED SECURITY BAR

(76) Inventor: Brandt Wolf, Philadelphia, PA (US)

( * ) Notice: Subject to any disclaimer, the term of this patent is extended or adjusted under 35 U.S.C. 154(b) by 0 days.

(21) Appl. No.: 13/592,505

(22) Filed: Aug. 23, 2012

(65) Prior Publication Data

US 2014/0054906 A1 Feb. 27, 2014

(51) Int. Cl.

| | |
|---|---|
| ***E05C 21/02*** | (2006.01) |
| ***E05C 19/00*** | (2006.01) |
| ***E05C 17/20*** | (2006.01) |
| *E05C 17/04* | (2006.01) |

(52) U.S. Cl.

CPC ..... *E05C 19/003* (2013.01); *E05C 17/20* (2013.01); *Y10S 292/25* (2013.01)

USPC . 292/259 R; 292/144; 292/262; 292/DIG. 25

(58) Field of Classification Search

CPC ..... E05C 17/20; E05C 19/00; E05C 19/003

USPC ..... 292/144, 259 R, 261–263, 289, DIG. 15, 292/DIG. 25, DIG. 46

See application file for complete search history.

(56) References Cited

U.S. PATENT DOCUMENTS

| | | | | |
|---|---|---|---|---|
| 1,361,317 | A | 12/1920 | Dulczewski et al. | |
| 2,116,446 | A * | 5/1938 | Nishimura | 49/280 |
| 3,354,677 | A | 11/1967 | Green | |
| 3,576,337 | A * | 4/1971 | Gudde | 292/201 |
| 3,751,088 | A | 8/1973 | Schlage et al. | |
| 3,821,884 | A | 7/1974 | Walsh | |
| 3,825,290 | A | 7/1974 | Messina et al. | |
| 4,068,875 | A | 1/1978 | Miller | |
| 4,135,376 | A | 1/1979 | Evans et al. | |
| 4,295,676 | A | 10/1981 | Smith | |
| 4,314,721 | A | 2/1982 | Clark | |

(Continued)

FOREIGN PATENT DOCUMENTS

| | | |
|---|---|---|
| DE | 3609091 | 9/1986 |
| DE | 4302835 | 6/1994 |

(Continued)

OTHER PUBLICATIONS

Screen shots from the website of www.alibaba.com printed Jun. 27, 2012 (7 pgs).

(Continued)

*Primary Examiner* — Carlos Lugo

(74) *Attorney, Agent, or Firm* — Stradley Ronon Stevens & Young, LLP

(57) ABSTRACT

A remote-controlled security apparatus for a door or window (opening) including a security bar, a motor-driven apparatus such as a linear actuator, and a remote control. The security bar has a first end hingeably connected to a first portion, such as a frame or jamb, of the opening and a second end sized to extend substantially across at least a portion of a width or height of the opening. The motor-driven apparatus includes a first end affixed to a second portion of the frame of the opening and a second end coupled to the security bar. The remote control directs the actuator to move the security bar between locked and unlocked positions. When locked, the security bar extends substantially across at least a portion of the width or the height of the opening. The security apparatus can securely lock a pair of sliding doors and control access remotely.

23 Claims, 7 Drawing Sheets

(56) References Cited

U.S. PATENT DOCUMENTS

| | | | | | |
|---|---|---|---|---|---|
| 4,349,223 | A | * | 9/1982 | Spector | 292/259 R |
| 4,437,694 | A | | 3/1984 | Lillo | |
| 4,685,316 | A | | 8/1987 | Hicks et al. | |
| 4,685,709 | A | | 8/1987 | Kambic | |
| 4,776,619 | A | | 10/1988 | Daugherty et al. | |
| 4,917,419 | A | * | 4/1990 | Mora et al. | 292/144 |
| 4,993,757 | A | * | 2/1991 | Corzine | 292/144 |
| 5,027,629 | A | | 7/1991 | Liu | |
| 5,141,272 | A | * | 8/1992 | Veillette | 292/338 |
| 5,261,260 | A | * | 11/1993 | Lin | 70/280 |
| 5,282,656 | A | * | 2/1994 | Fizer | 292/259 R |
| 5,340,171 | A | | 8/1994 | Slaybuagh et al. | |
| 5,385,039 | A | | 1/1995 | Feldpausch et al. | |
| 5,437,174 | A | | 8/1995 | Aydin | |
| 5,475,996 | A | | 12/1995 | Chen | |
| 5,551,188 | A | | 9/1996 | Davlantes | |
| 5,636,536 | A | | 6/1997 | Kinnucan | |
| 5,686,899 | A | * | 11/1997 | Hosmer | 340/5.64 |
| 5,760,703 | A | | 6/1998 | Becker | |
| 5,775,639 | A | * | 7/1998 | Fage | 244/110 B |
| 5,823,026 | A | * | 10/1998 | Finke | 70/276 |
| 5,934,719 | A | | 8/1999 | Athanasios | |
| 5,941,578 | A | | 8/1999 | Shamblin | |
| 6,032,500 | A | * | 3/2000 | Collard et al. | 70/278.1 |
| 6,035,676 | A | | 3/2000 | Hudspeth | |
| 6,050,116 | A | * | 4/2000 | Cole | 70/256 |
| 6,076,385 | A | | 6/2000 | Pedroso et al. | |
| 6,318,138 | B1 | | 11/2001 | Mathews et al. | |
| 6,318,196 | B1 | * | 11/2001 | Chang | 74/89.12 |
| 6,644,072 | B1 | | 11/2003 | Hsich | |
| 7,024,820 | B1 | | 4/2006 | Dustin | |
| 7,086,258 | B2 | | 8/2006 | Fisher et al. | |
| 7,484,391 | B1 | | 2/2009 | Moore | |
| 7,603,882 | B2 | * | 10/2009 | Carbajal et al. | 70/267 |
| 7,731,252 | B1 | | 6/2010 | Stewart | |
| 7,775,072 | B2 | | 8/2010 | Pullmann et al. | |
| 7,845,176 | B2 | * | 12/2010 | Martin | 60/770 |
| 2010/0180504 | A1 | | 7/2010 | Kernaghan et al. | |
| 2010/0281933 | A1 | | 11/2010 | Barrieau | |

FOREIGN PATENT DOCUMENTS

| | | |
|---|---|---|
| EP | 0174790 | 3/1986 |
| EP | 0173987 | 7/1989 |
| EP | 0333588 | 9/1989 |
| EP | 0757147 | 2/1997 |
| EP | 1845054 | 10/2007 |
| FR | 2331663 | 6/1977 |
| FR | 2546219 | 11/1984 |
| GB | 137136 | 1/1920 |
| GB | 730292 | 5/1955 |
| GB | 895699 | 5/1962 |
| GB | 924761 | 5/1963 |
| GB | 2125874 | 3/1984 |
| GB | 2208302 | 3/1989 |
| GB | 2290107 | 12/1995 |
| WO | 03095774 | 11/2003 |

OTHER PUBLICATIONS

Screen shots from the website of www.firgelliauto.com printed May 29, 2012 (6 pgs).

Screen shot from the website of www.homedopot.com printed May 29, 2012 (1 pg).

* cited by examiner

REMOTE-CONTROLLED SECURITY BAR

TECHNICAL FIELD

The present invention relates generally to remote-controlled security bars, especially suitable for door applications, such as for preventing access through a sliding door.

BACKGROUND OF THE INVENTION

There are a number of security concerns for doors and windows, especially sliding doors, where intruders may obtain unauthorized access or children may open the doors without parental authority. There are a number of pivoting door locks and window fasteners available. For example, locking devices for sliding parallel door panels may include conventional key-operated locks as well as the use of a simple rigid bar placed between the sliding panel and the door jamb.

There are a number of drawbacks, however, with these traditional security devices. In particular, the security devices may be expensive and difficult to install. The devices may require manual operation; for example, the rigid bar needs to be manually placed into a locked or unlocked position. In addition, in the case of a rigid bar in a sliding door, once installed, the door may not be opened from the outside by anyone, including the homeowner.

SUMMARY OF THE INVENTION

To overcome these and other drawbacks, the present invention provides a remote-controlled security apparatus and system. The apparatus may include a security bar and a remote-controlled motor-driven apparatus (e.g., an actuator). The security bar provides for a visual deterrent to intruders. The remote control allows the operator or homeowner to change the position of the security bar, hands-free, easily, and quickly between locked and unlocked positions. The remote control also allows the homeowner to control the security bar position at a distance and even from outside the dwelling. Therefore, a door, such as a sliding or patio door, may be accessed via a keyless entry.

In one embodiment of the present invention, a remote-controlled security apparatus for a door or window includes a security bar having a first end hingeably connected to a first portion of a frame of the door or the window and a second end sized to extend substantially across at least a portion of a width or height of the door or the window; a motor-driven apparatus (e.g., a linear actuator) having a first end affixed to a second portion of the frame of the door or the window (e.g., proximate the first portion) and a second end coupled to the security bar; and a remote control which controls the motor-driven apparatus to move the security bar between locked and unlocked positions. The security bar is in a locked position when the security bar extends substantially across at least a portion of the width or the height of the door or the window.

The security bar may be an adjustable-length security bar, for example, where the length of the security bar may be incrementally adjusted to a length which is the same, less than, or more than the width or the height of the door or the window. Thus, for example, the same security bar may be installed on and function with a number of doors or windows of different sizes. The security bar may be in the locked position when the security bar is in a substantially horizontal position.

The motor-driven apparatus may be removably coupled to the security bar for emergency or manual operation. The security bar and the motor-driven apparatus may be connected to a vertical jamb of the door. The door may include a sliding door or a hinged door, for example.

In another embodiment of the present invention, a security system for securely locking at least one door having first and second parallel vertical door jambs and a width therebetween includes a rigid elongated security bar sized to extend substantially horizontally across at least a portion of the width of the door. The security bar may be hinge mounted to the first door jamb, with the security bar hinge permitting pivotal motion of the security bar between a substantially vertical position and a substantially horizontal position. A linear actuator has a first end mounted to the first door jamb and a second end mounted to the security bar proximate the security bar hinge. A remote control moves the actuator between extended and retracted positions. The security bar is in a locked position when the security bar is in the substantially horizontal position and the actuator is in a retracted position, and the security bar is in one or more unlocked positions when the actuator extends and pivots the security bar out of the substantially horizontal position.

The security apparatus or system may also include a lock, a stop, or both. The stop may maintain the security bar in a substantially horizontal position, for example, when the security bar contacts the stop. In the case of a hinged door, the stop may also provide an additional locking feature (e.g., a U-shaped or J-shaped stop) to prevent the door from opening in either direction. The lock may fix the security bar in any one of a number of positions.

In another embodiment of the present invention, a security system for securely locking a pair of sliding doors having a first door and a second door in a sliding door track includes a rigid elongated security bar sized to extend substantially horizontally across at least a portion of the first door. A security bar hinge mounts the security bar to a door jamb, the security bar hinge permitting pivotal motion of the security bar between a substantially vertical position and a substantially horizontal position. A linear actuator has a first end mounted to the door jamb and a second end mounted to the security bar with a hinged mounting bracket proximate the security bar hinge. A remote control moves the actuator between extended and retracted positions. The security bar is in a locked position when the security bar is in the substantially horizontal position, the actuator is in a retracted position, and the second door is not able to slide in the sliding door track past an end of the security bar. The security bar is in one or more unlocked positions when the actuator extends and pivots the security bar out of the substantially horizontal position and the second door is able to slide in the sliding door track.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

The present invention provides remote-controlled security apparatuses and systems for doors and windows in buildings, including dwellings and commercial structures. The remote control feature allows for keyless and automatic control of a security bar.

The remote-controlled security apparatus may be particularly suitable for sliding door or patio door applications. Sliding doors or patio doors generally include a pair of panel members, usually made of glass, mounted in coplanar relation within a frame. One of the panels is usually supported for horizontal sliding movement (e.g., a slidable door) relative to the other panel (e.g., a fixed door). The doors are supported within a track typically contained in or formed by the frame, so that the sliding door panel can be slid open or closed relative to the fixed panel. The sliding doors may also include doors where both doors move or are slidable relative to one another.

The remote-controlled apparatus may also be suitable for traditional hinged doors. Hinged doors may include a single door or more than one door hingeably coupled to the door frame or jamb (e.g., with three barrel hinges). The hinges may be positioned along one side of the door frame to allow the door to pivot along a vertical axis of rotation. Other applications may include, for example, window applications, such as traditional single-hung or double-hung sash windows where one or more panels of the window move vertically relative to one another. The security apparatus may also be suitable for other types of interior and exterior doors and windows, such as bi-fold doors, French doors, revolving doors, horizontal sliding sash windows, and the like.

Figure 1:
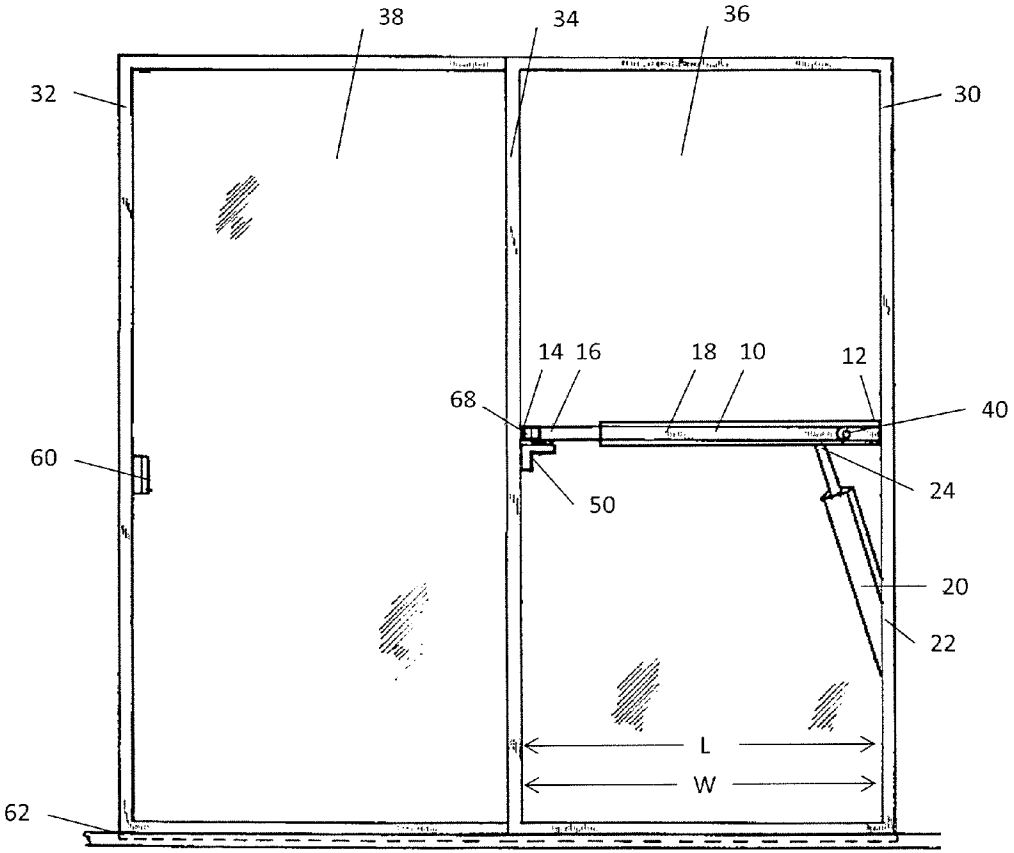
FIG. 1 shows a sliding door with a security apparatus including a security bar and a remote-controlled actuator in a locked position according to one embodiment of the present invention.

Referring now to the drawing, in which like reference numbers refer to like elements throughout the various figures that comprise the drawing, FIG. 1 shows a remote-controlled security apparatus with a security bar 10. The security bar 10 may include a first end 12 and a second end 14. The security bar 10 may have a fixed length L. Alternatively, the security bar 10 may be of varying length L. For example, the length L of the security bar 10 may be adjustable. An adjustable security bar 10 may include a fixed portion 18, which does not move, and an adjustable portion 16, which does move. The adjustable portion 16 may extend or retract, for example, from within the fixed portion 18, to provide the desired length of the security bar 10. The adjustable portion 16 may be arranged at least partially in a telescoping fashion within the fixed portion 18.

Depending on the application, the length L of the security bar 10 may be adjusted to a length which is equal to, less than, or more than the width W or the height H of the door 36 or the window 70. In a preferred embodiment, the length L of the security bar 10 should be approximately equivalent to the width W or height H of the door 36 or window 70 to be secured. There may be different lengths of security bars 10 based on the application desired and the traditional widths and heights of doors and windows. For example, in the case of a sliding door, the security bar 10 is preferably of fixed length L or adjustable to the standard width W of the first (fixed) door 36 (e.g., between about 28 inches and 36 inches in width W). In the case of a hinged door (FIG. 6), preferably the length L of the security bar 10 extends beyond the width W of the door 36 (e.g., greater than about standard door widths between 28 inches and 36 inches). In the case of a sash window (FIG. 7), preferably the length L of the security bar 10 is approximately equivalent to the height H of the top sash (e.g., about 30 inches for a 60 inch window).

The length L of the security bar 10 may be incrementally adjusted, manually or remotely, to the desired length when in use. The incremental adjustment may include increasing or decreasing the length L of the security bar 10 by some given value (e.g., ¼ inch increments). The length L of the security bar 10 may be adjusted using any suitable techniques known in the art. For example, the fixed portion 18 of the security bar 10 may contain holes or openings suitable for accommodating spring pins or tension pins positioned along the length of the adjustable portion 16 of the security bar 10. The length L of the security bar 10 may be adjusted by pushing in the pin and locking the pin into a different hole. Alternatively, the adjustable portion 16 may be twisted (e.g., like a spring tension rod) to the desired length L.

Figure 5:
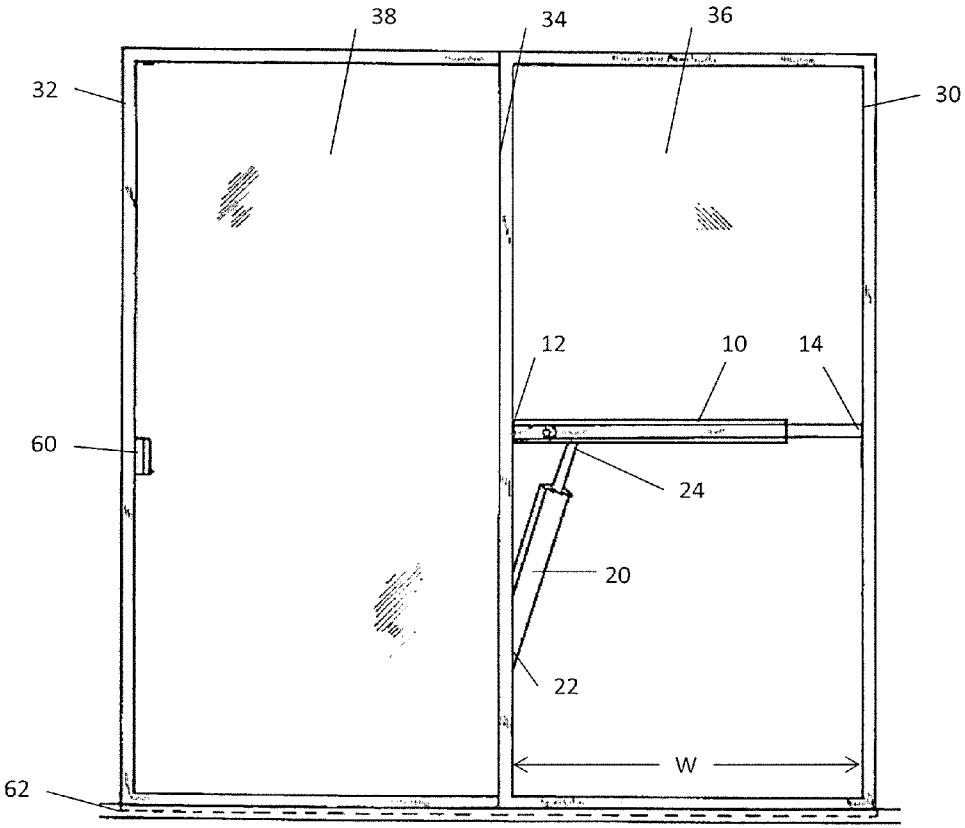
FIG. 5 shows the sliding door depicted in FIG. 1 where the security apparatus is affixed to the frame of the sliding door in an alternative position according to one embodiment of the present invention.

The first end 12 of the security bar 10 is connected to a first portion of the frame of the door 36 or the window 70. The frame may include any structure defining or affixed to the perimeter of the door 36 or the window 70 (e.g., any suitable mounting surface such as a jamb or the like). The security bar 10 may be affixed to the frame of the door 36 or the window 70 using any suitable mechanisms known in the art (e.g., a mounting bracket with screws, etc.). The security bar 10 may be affixed to any suitable portion of the frame of the door 36 or the window 70. Preferably, the security bar 10 is affixed to the frame or jamb (e.g., a non-moveable portion) of the door 36 or the window 70. It is possible, however, that the security bar 10 may be affixed to a movable portion of the door frame, for example, the frame 34 of the second (slidable) door 38, as depicted in FIG. 5.

In the case of a sliding door, for example, as depicted in FIG. 1, the door may be part of a pair of doors including a first door 36 and a second door 38 provided in a frame and on a sliding door track 62. The second door 38 may be the slidable door where the first door 36 may be the fixed door. The slidable second door 38 typically has a handle 60 adapted to be grasped by the user to open and close the second door 38 easily. Alternatively, both the first door 36 and the second door 38 may be slidable doors (each having a handle 60). The sliding door frame may include two vertical door jambs, e.g., a first door jamb 30 and a second door jamb 32. The first end 12 of the security bar 10 may be affixed to the first door jamb 30. The security bar 10 may be affixed to the first door jamb 30 at any suitable location along the height of the first door 36 so long as the security bar is operable. In an exemplary embodiment, the security bar 10 is substantially centrally located along the height of the first door 36 for maximum visibility to intruders and to avoid any rotation of the second door 38 should an intruder try to open the second door 38 against the force of the security bar 10. It is also contemplated, however, that the security bar 10 may be positioned along the bottom or top of the door 36.

Figure 6:
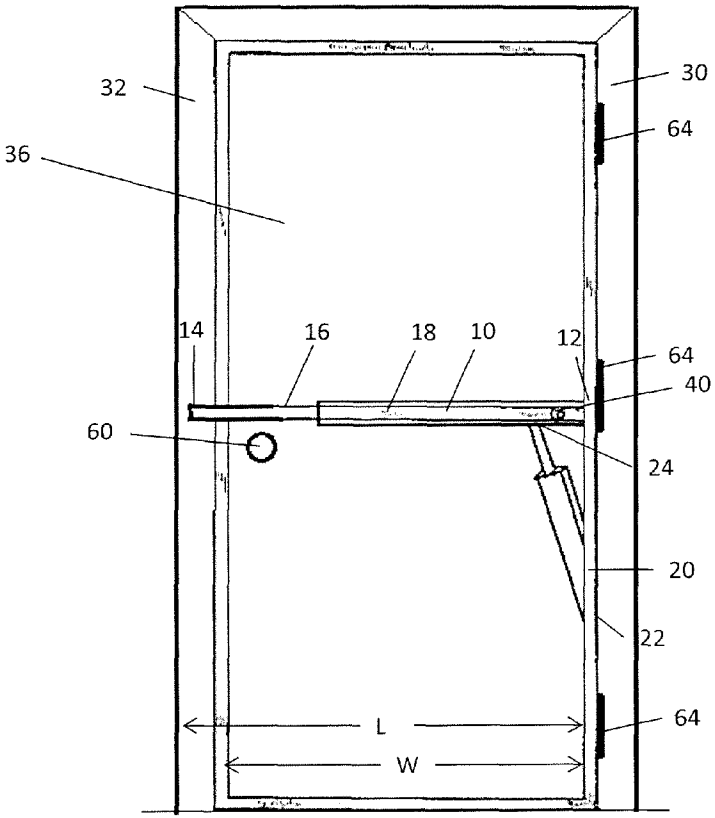
FIG. 6 depicts a hinged door with a security apparatus including a security bar and a remote-controlled actuator in a locked position according to one embodiment of the present invention.

In the case of a hinged door, for example, as depicted in FIG. 6, the door 36 may be a single door provided in a frame with two parallel vertical door jambs, e.g., a first door jamb 30 where the hinges 64 of the door 36 are connected and a second door jamb 32 where the door opens and latches. The first end 12 of the security bar 10 may be affixed to the first door jamb 30 at any suitable location along the height of the door 36 so long as the security bar is operable. In an exemplary embodiment, the security bar 10 is substantially centrally located along the height of the first door 36 for maximum security.

Figure 7:
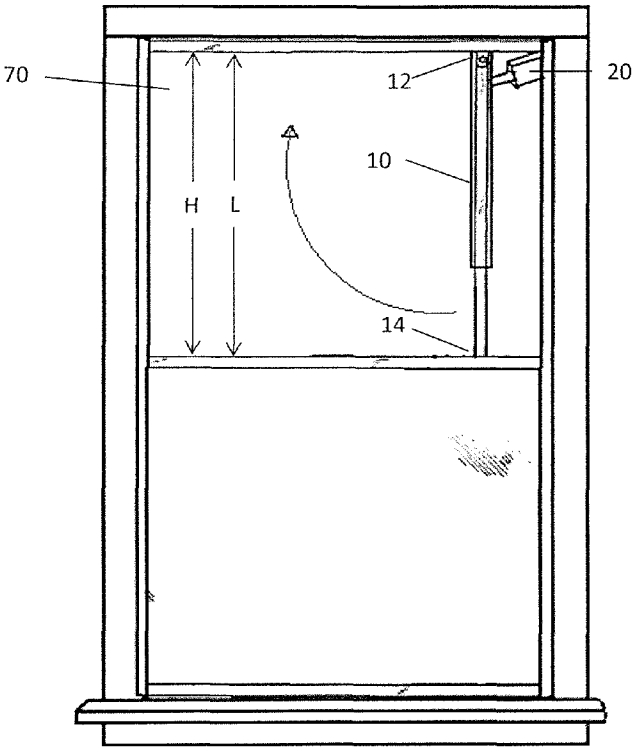
FIG. 7 shows a sash window with a security apparatus including a security bar and a remote-controlled actuator in a locked position according to one embodiment of the present invention.

In the case of a sash window, for example, as depicted in FIG. 7, the window frame may include two parallel vertical portions and two parallel horizontal portions. The first end 12 of the security bar 10 may be affixed to the upper horizontal portion of the window frame at any suitable location along the width of the upper window sash so long as the security bar 10 is operable. In one embodiment, the security bar 10 may be substantially centrally located along the width of the window 70 for maximum visibility. It is also contemplated, however, that the security bar 10 may be positioned along the left or right regions of the window 70 for reduced visibility.

The security bar 10 is hingeably connected to the door 36 or the window 70 using any suitable mechanisms known in the art. For example, a hinge 40 may be directly affixed to the door or window frame and directly affixed to the security bar 10. The hinge 40 may be affixed to a mounting bracket or other suitable support. The security bar 10 also may include a hinge 40 somewhere along its length L (e.g., proximate the first end 12). Preferably, the hinge assembly is part of the mounting bracket for affixing the security bar 10 to the door 36 or window 70 (and may be recessed within a sliding door frame). The hinge 40 may include a barrel hinge, pivot hinge, H hinge, flush hinge, or the like. The hinge 40 preferably allows the security bar 10 to pivot along one axis (e.g., a horizontal axis or a vertical axis) depending on the application. For a sliding door, the hinge 40 preferably pivots along a vertical axis (e.g., pivots from a substantially horizontal position to a substantially vertical position and vice versa).

Figure 3:
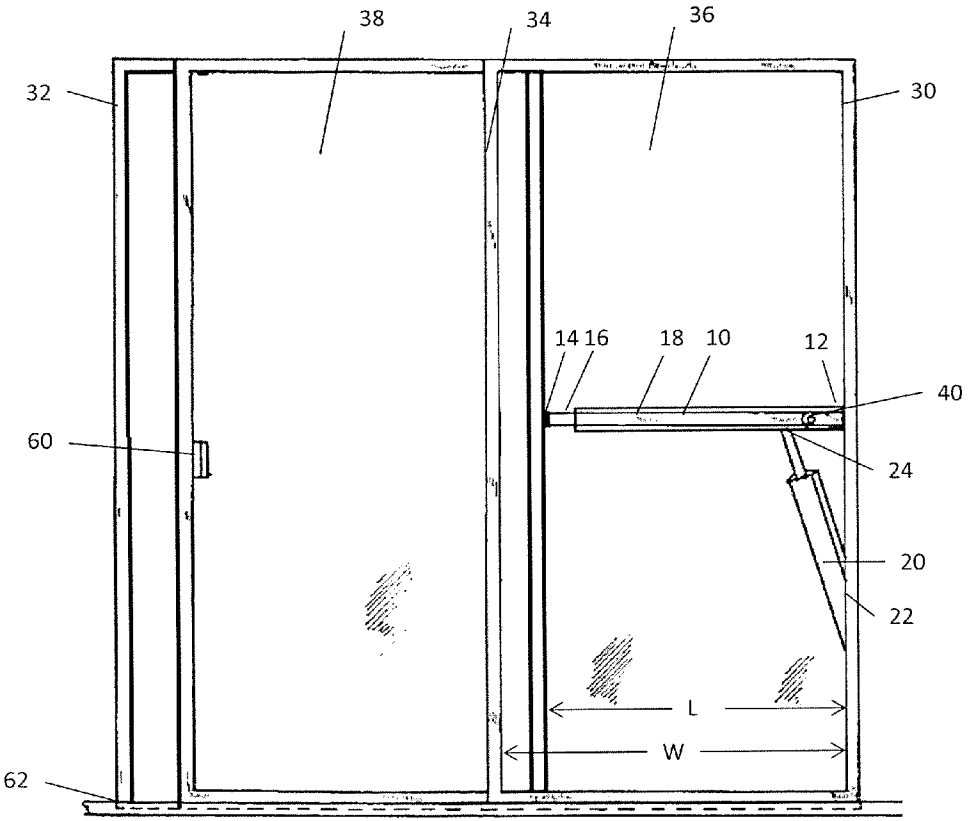
FIG. 3 shows the sliding door depicted in FIG. 1 with the security apparatus in a locked position but the sliding door may be opened to a given distance based on the length of the security bar.

The second end 14 of the security bar 10 is sized to extend substantially across at least a portion of the width W or height H of the door 36 or the window 70. The security bar 10 may have a fixed or an adjustable length L. In the case of a sliding door, the length L of the security bar 10 should be sized to extend substantially across the entire width W of the door 36, as shown in FIG. 1 or a portion of the width of the door 36, as shown in FIG. 3. The length L of the security bar 10 may be incrementally adjusted to the desired length, which may include the width W of the door 36, the height H of the window 70, some value less than the width W or height H of the door 36 or window 70, or some value greater than the width W or height H of the door 36 or window 70.

If the security bar 10 is sized to extend substantially across the entire width W of the door 36 (FIG. 1), the slidable door 38 would not be permitted to open at all. If the security bar 10 is sized to extend across some portion of the width W of the door 36 (FIG. 3), the slidable door 38 would be permitted to open, but only the portion of the width W not traversed by the security bar 10. This would allow for air to circulate through the opening in the slidable door 38, but the opening could be small enough that an intruder or child could not pass through the gap. For example, the gap or space for the open slidable door 38 and corresponding to the width W of the door 36 not covered by the security bar 10 could range from about 1% to 25%, preferably about 1% to 10%, more preferably about 2% to 8% of the width W of the door 36 (e.g., about 1 inch to 3 inches in the case of a 28 inch to 36 inch door).

In the case of a fixed door, the length L of the security bar 10 may be sized to extend substantially across the entire width W of the door 36, as shown in FIG. 6, plus some distance beyond the width W of the door 36 suitable to securely prevent the door 36 from opening. For example, the additional distance could range from about 1% to 25% greater than width W of the door 36. In the embodiment depicted in FIG. 6, this configuration would prevent the door from opening outward (into the page). The security bar 10 may also be sized at the second end 14 to enter a stop 50 (see FIG. 1) or the stop 50 may be on the security bar 10 (not shown). The stop 50 may be U-shaped, J-shaped, L-shaped, C-shaped, or H-shaped, for example, to prevent the door 36 from opening in either direction and provide an additional locking feature. The U-shaped, J-shaped, L-shaped, C-shaped, or H-shaped stop 50 may also prevent the door 36 from opening in an inward direction (out of the page).

In the case of a window 70, the length L of the of the security bar 10 may be sized to extend substantially the across the entire height H of the window sash, as shown in FIG. 7, or a portion of the height H of the window sash (not shown). If the security bar 10 is sized to extend substantially across the entire height H of the window sash (FIG. 7), the lower window would not be permitted to open at all. It is noted that the upper window should also be locked or secured in some fashion to prevent unauthorized entry. If the security bar 10 is sized to extend along some portion of the height H of the window sash (not shown), the lower window would be permitted to open, but only the portion of the height H not traversed by the security bar 10. This would allow for air to circulate through the opening in the window 70, but the opening could be small enough that an intruder or child could not pass through the gap. For example, the gap or space for the open window 70 and corresponding to the height H of the window sash not covered by the security bar 10 could range from about 1% to 25%, preferably about 1% to 15%, more preferably about 3% to 10% of the height H of the window 70 (e.g., about 1 inch to 3 inches in the case of a 30 inch window sash).

The security bar 10 may comprise a rigid elongated member. As used in this document, "rigid" refers to a material that does not bend or does not substantially bend or deform when a force is applied, but does not preclude some minor shape distortion under pressure. The security bar 10 may be constructed of any suitable material known in the art. For example, the security bar 10 may comprise aluminum, steel (e.g., stainless steel or alloy steel), copper, tungsten, titanium, metal carbides, fiberglass, vinyl, and the like. The security bar 10 may also be coated with a coating, e.g., a metal or plastic coating, to minimize or prevent rust or for aesthetics. The security bar 10 preferably is an elongated member because the length L of the security bar 10 is greater than the width of the security bar 10 (e.g., about 20 to 40 times greater in length L than width). The security bar 10 may also be of any suitable shape. The security bar 10 may comprise a square profile, a spherical profile, or the like. If the security bar 10 is adjustable, the profile of the fixed portion 18 and the adjustable portion 16 may be sized and configured such that the adjustable portion 16 recesses into the fixed portion 18 or vice versa. For example, the fixed portion 18 may have a wide diameter compared to the adjustable portion 16 having a comparatively narrow diameter.

The remote-controlled security apparatus also includes a motor-driven apparatus. The motor-driven apparatus may include any apparatus comprising a motor which can change, move, or control the position of the security bar 10 (e.g., between locked and unlocked positions). Preferably, the motor-driven apparatus provides for substantially linear motion along a single axis. Suitable motor-driven apparatus may include, but are not limited to, actuators (e.g., linear actuators), servo motors, worm gear drives, linear rail/guide drives, and linear motion positioners. Preferably, the motor-driven apparatus is small and compact. For a sliding door, the motor-driven apparatus may at least partially recess into the door frame, for example, when fully extended, and the security bar 10 may also at least partially recess into the door frame.

In one embodiment, the remote-controlled security apparatus may include an actuator 20. The actuator 20 may be operated by electric current, hydraulic fluid pressure, or pneumatic pressure, and provides some type of motion (e.g., linear motion). In particular, the actuator 20 moves the security bar 10 (e.g., along a horizontal or vertical axis) to the desired position (e.g., between locked and unlocked positions). In an exemplary embodiment, the actuator 20 is a linear actuator. A linear actuator may comprise function along any suitable stroke (e.g., 2-12 inch stoke), load capacity (e.g., 5 to 25 lbs. of force), and speed. In an exemplary embodiment, the linear actuator is a 4 inch stroke electric linear actuator with a load capacity of 8 lbs. of force.

Figure 4:
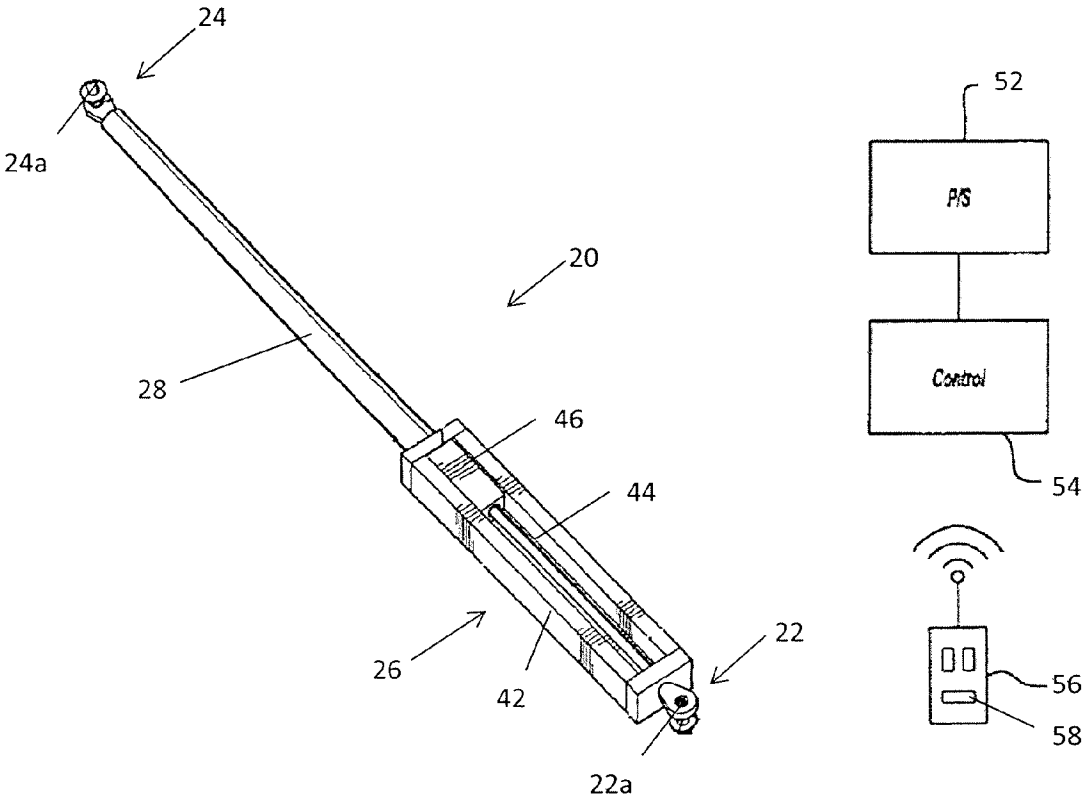
FIG. 4 depicts an example of a remote-controlled linear actuator suitable for use in one embodiment of the present invention.

One example of a linear actuator is depicted in FIG. 4. The actuator 20 may include a linear electric motor 26 and a telescoping cylinder 28 (e.g., piston) mounted on the linear electric motor 26 along a common axis. The telescoping cylinder 28 includes a shaft 44 which telescopes in and out of the telescoping cylinder 28. The linear electric motor 26 includes a linear stator 42 and a slidable rotor 46 which is drivable relative to the linear stator 42. The linear stator 42 may be U-shaped in cross-section, for example, to receive the slidable rotor 46. One end of the linear stator 42 may be mounted to the shaft 44, for example, by a bracket or the like. The opposite end of the linear stator 42 is preferably slidably mounted to the telescoping cylinder 28, for example, by a bracket or the like. The slidable rotor 46 may be attached to an end of the telescoping cylinder 28 from which the shaft 44 extends.

By activating the linear electric motor 26, the slidable rotor 46 moves along the linear stator 42 to drive the actuator 20 between an extended position (shown in FIG. 4) and a retracted position (not shown). For example, when the actuator 20 is in a retracted position for a door 36, the security bar 10 is substantially horizontal. The security bar 10 may be substantially vertical when the actuator 20 is fully extended, but it may also be substantially vertical when the actuator 20 is extended to a point somewhat less than fully extended. In addition, the security bar 10 may be at a position somewhere between horizontal and vertical when the actuator 20 is partly extended. Although a linear actuator 20 is exemplified in this document, any suitable type or configuration for the motor-driven apparatus may be selected by one of ordinary skill in the art.

The actuator 20 has a first end 22 comprising the fixed portion of the actuator 20. The first end 22 of the actuator 20 is affixed to a second portion of the frame of the door 36 or the window 70. The actuator 20 may be affixed the frame of the door 36 or window 70 using any suitable mechanisms known in the art (e.g., a mounting bracket with screws, etc.). The actuator 20 may be affixed to any suitable portion of the door or window. Preferably, the actuator 20 is affixed to the door or window frame or jamb (e.g., a non-moveable portion). It is possible, however, that the actuator 20 may be affixed to a movable portion of the door frame, for example, as depicted in FIG. 5. Preferably, the first end 22 of the actuator is affixed near or proximate the first end 12 of the security bar 10 in order to provide proper leverage on the security bar 10. A connector 22*a* may be located at the first end 22 of the actuator 20 for mounting to the frame of the door 36 or window 70. Any suitable connector may be selected by one of ordinary skill in the art.

In the case of a sliding door, for example, as depicted in FIG. 1, the first end 22 of the actuator 20 may be affixed to the first door jamb 30. The actuator 20 may be affixed to the first door jamb 30 at any suitable location along the height of the first door 36 so long as the security bar 10 is operable. In an exemplary embodiment, the actuator 20 is positioned below the security bar 10. It is also contemplated, however, that the actuator 20 may be positioned above the security bar 10.

In the case of a hinged door, for example, as depicted in FIG. 6, the first end 22 of the actuator 20 may be affixed to the first door jamb 30 at any suitable location along the height of the first door 36 so long as the security bar 10 is operable. In an exemplary embodiment, the actuator 20 is positioned below the security bar 10.

In the case of a sash window, for example, as depicted in FIG. 7, the first end 22 of the actuator 20 may be affixed to the upper horizontal portion of the window frame or either of the parallel vertical portions of the window frame at any suitable location along the width or height of the upper window sash so long as the security bar 10 is operable. In one embodiment, the actuator 20 is located at the top of the vertical window frame.

The actuator 20 has a second end 24 comprising the movable portion (e.g., telescoping piston) of the actuator 20 coupled to the security bar 10. The second end 24 of the actuator 20 may be coupled to the security bar 10 at any suitable location along the length L of the security bar 10 in order to provide appropriate leverage to move the security bar 10 (e.g., along a single axis of rotation). In one embodiment, the second end 24 of the actuator 20 is coupled to the security bar 10 proximate the first end 12 of the security bar 10. In other words, the second end 24 of the actuator 20 is coupled to the security bar 10 near where the security bar 10 is hingeably mounted to the door 36 or window 70.

The actuator 20 may be coupled to the security bar 10 using any suitable connector known in the art. For example, an opening (not shown) or a connector 24*a* (FIG. 4) may be located at the second end 24 of the actuator 20 for mounting. If the second end 24 comprises an opening or hole, a bracket system may be used with a push or cross pin to facilitate up to 180° of pivotal motion. The bracket system may include, for example, a bracket portion on either side of the second end 24 of the actuator 20 with corresponding openings that align with the opening in the second end 24 of the actuator 20. The cross pin may then be inserted through each of the openings to connect the actuator 20 to the security bar 10 (e.g., a cotter pin).

In one embodiment, the actuator 20 may be hingeably connected to the security bar 10 using any suitable mechanisms known in the art. For example, a hinge may be directly affixed to the actuator 20 and directly affixed to the security bar 10 or a hinge may be affixed to a mounting bracket or other suitable support. Preferably, the hinge assembly is part of the mounting bracket for affixing the actuator 20 to the security bar 10. The hinge may include a pivot hinge, H hinge, flush hinge, or the like.

In an exemplary embodiment, the actuator 20 is removably coupled to the security bar 10. For example, the second end 24 of the actuator 20 may be mounted to the security bar 10 with a hinged mounting bracket comprising a pull pin (e.g., a spring mounted pin). The pull pin could be removed, for example, for emergency or manual operation of the security bar 10.

The remote-controlled security apparatus may include a remote control 56 which controls the actuator 20 and moves the security bar 10 between locked and unlocked positions. The length L of the security bar 10 may also be incrementally controlled by the remote control 56. The actuator 20 may be connected to a power supply, power source (P/S), or power adapter 52 (e.g., a 12 volt DC power adapter). The actuator 20 may also be hard-wired, battery operated, battery back-up, or wirelessly connected to a controller or remote control receiver/transmitter 54. The controller 54 may receive commands from the remote control 56, such as a key fob, which is operable to transmit open and close commands. It is also contemplated that the remote control 56 could encompass an internet-controlled system (e.g., a cell phone or tablet), which may be programmed to know the position of the security bar 10 and control the security bar 10 between different positions. Suitable controllers 54 and programming may be selected and performed by one of ordinary skill in the art.

The remote control 56 may be programmed to provide any desired function. For example, the remote control 56 may be programmed such that when a button 58 on the remote control 56 is depressed the actuator 20 moves the security bar 10 between the locked and unlocked positions or between the unlocked and locked positions. Thus, for a period of time when the button 58 is depressed on the remote control 56 the actuator 20 and security bar 10 are moving (unless already in a fully extended or retracted position). The remote control 56 may also be programmed such that the actuator 20 is known to have a first retracted position when the security bar 10 is in the locked position and the actuator 20 is fully retracted; and a second extended position when the security bar 10 is in an unlocked position and the actuator 20 is fully extended. Therefore, when a button 58 on the remote control 56 is depressed once, the actuator 20 automatically moves between the first retracted position and the second extended position or vice versa.

The security bar 10 is in a locked position when the security bar 10 extends substantially across at least a portion of the width W or the height H of the door 36 or the window 70. The security bar 10 may be in a locked position when oriented horizontally or vertically depending on the operation of the door 36 or window 70.

In the case of a sliding door, for example as depicted in FIGS. 1, 3, and 5, the door 36 is locked when the security bar 10 extends substantially across the entire width W of the door 36 (FIG. 1) or a portion of the width W of the door 36 (FIG. 3). If the security bar 10 extends substantially across the entire width W of the door 36 (FIG. 1), the slidable door 38 is locked and the slidable door 38 does not open at all. If the security bar 10 extends some portion of the width W of the door 36 (FIG. 3), the slidable door 38 is also locked, but the slidable door 38 is permitted to open the portion of the width W not traversed by the security bar 10. This locked configuration would allow for air to circulate through the partially open doorway, but the opening could be sized to be small enough that an intruder or child could not pass through the gap. In an exemplary embodiment, the locked position includes the security bar 10 in a substantially horizontal position.

In the case of a fixed door, for example as depicted in FIG. 6, the door 36 is locked when the length L of the security bar 10 extends substantially across the entire width W of the door 36 as shown in FIG. 6 plus some distance beyond the width of the door 36 suitable to securely prevent the door from opening. In an exemplary embodiment, the locked position includes the security bar 10 in a substantially horizontal position.

In the case of a window, for example as depicted in FIG. 7, the window 70 is locked when the length L of the security bar 10 extends substantially across the entire height H of the sash of the window 70 (FIG. 7) or a portion of the height H of the sash of the window 70 (not shown). If the security bar 10 extends substantially across the entire height H of the sash of the window 70 (FIG. 7), the window 70 is locked and the lower window would not be permitted to open at all. If the security bar 10 extends along some portion of the height H of the sash of the window 70 (not shown), the window 70 is still locked but the lower window 70 would be permitted to open the portion of the height H not traversed by the security bar 10. This would allow for air to circulate through the open window 70, but the opening could be sized to be small enough that an intruder or child could not pass through the gap. In an exemplary embodiment, the locked position includes the security bar 10 in a substantially vertical position.

Figure 2:
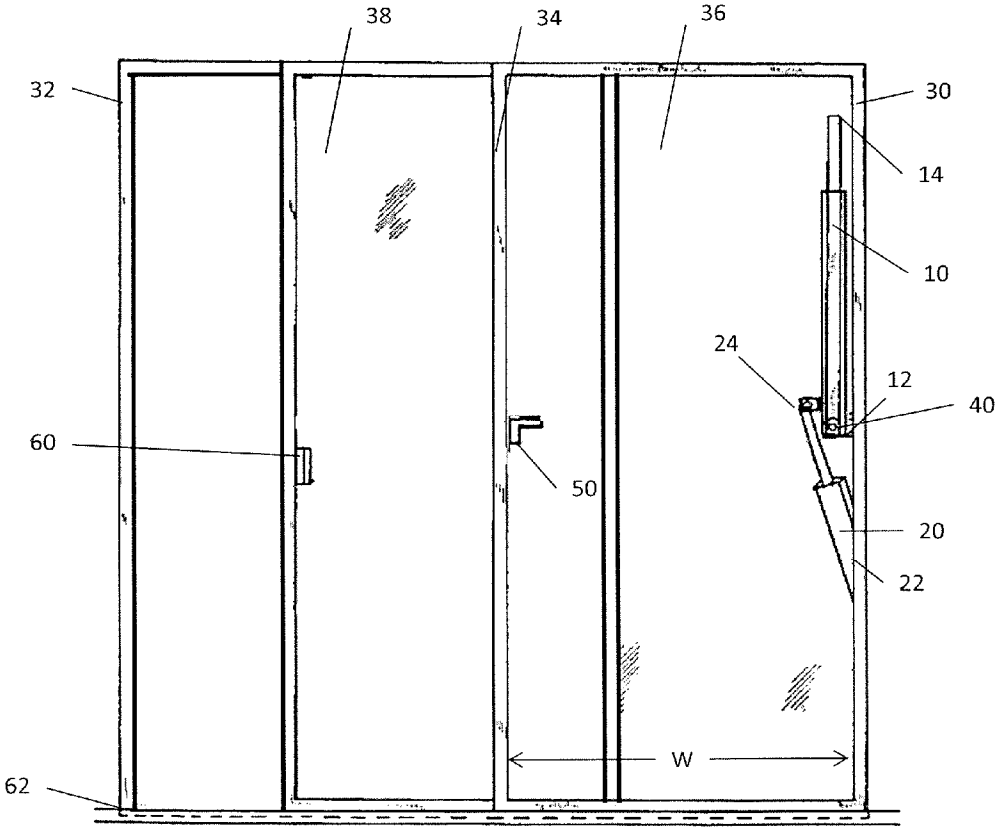
FIG. 2 shows the sliding door depicted in FIG. 1 with the security apparatus in an unlocked position and the sliding door in an open position.

The security bar 10 is in an unlocked position when the security bar 10 is not locked. In the case of a sliding door or hinged door, the door 36 may be unlocked when the length L of the security bar 10 does not extend substantially across the entire width W of the door 36, for example, in a substantially horizontal configuration. Thus, the door 36 may be unlocked when the security bar 10 is in a substantially vertical configuration (FIG. 2). For a sliding door, the security bar 10 and actuator 20 may be partially or fully recessed into the door frame when substantially vertical. The door 36 may also be unlocked when the security bar 10 is at some angle between horizontal (0°) and vertical (90°). In other words, if the security bar 10 is not in the locked position, it may be possible for one to open or force open the door 36.

In the case of a window, the window 70 may be unlocked when the length L of the security bar 10 does not extend substantially across the entire height H of the sash of the window 70, for example, in a substantially vertical configuration. Thus, the window 70 may be unlocked when the security bar 10 is in a horizontal configuration (not shown). The window 70 may also be unlocked when the security bar 10 is at some angle between vertical (0°) and horizontal (90°). In other words, if the security bar 10 is not in the locked position, it may be possible for one to open or force open the window 70.

In an exemplary embodiment, a security system for securely locking a pair of sliding doors having a first door and a second door in a sliding door track includes a rigid elongated security bar 10 sized to extend substantially horizontally across at least a portion of the first door. A security bar hinge mounts the security bar 10 to a door jamb, the security bar hinge permitting pivotal motion of the security bar 10 between a substantially vertical position and a substantially horizontal position. A linear actuator 20 has a first end 22 mounted to the door jamb and a second end 24 mounted to the security bar 10 with a hinged mounting bracket proximate the security bar hinge. A remote control 56 moves the actuator 20 between extended and retracted positions. The security bar 10 is in a locked position when the security bar 10 is in the substantially horizontal position, the actuator 20 is in a retracted position, and the second door is not able to slide in the sliding door track past an end of the security bar 10. The security bar 10 is in one or more unlocked positions when the actuator 20 extends and pivots the security bar 10 out of the substantially horizontal position and the second door is able to slide in the sliding door track.

The remote-controlled security apparatus may include other features, such as additional locking mechanisms, stops, additional motors, etc. For example, the security bar 10 may include at least one lock 68. For example, the security bar 10 may include a lock 68 on the first end 12 or the second end 14 of the security bar 10. The lock 68 may be configured to engage the frame of the door or window. In the case of the sliding door, the lock 68 may be designed to engage the frame of the adjacent door. The lock 68 may include a manual lock (e.g., a deadbolt type lock), a keyed lock, a magnetic lock, or other suitable lock.

The remote-controlled security apparatus may include a stop 50. For example, the stop 50 may be mounted to a portion of the door or window substantially opposite and parallel to the first portion where the first end 12 of the security bar 10 is mounted to the door 36 or window 70. The stop 50 may be mounted directly to the door 36 (e.g., in the case of a hinged door 36) or may be mounted onto the door frame or jamb. In the alternative or in addition, the stop 50 may be part of, on, or integral with the security bar 10 (e.g., proximate an end of the security bar 10). The stop 50 may include, for example, an electronic switch (e.g., a dip switch). The stop 50 may be configured to maintain the security bar 10 in a substantially horizontal or vertical position when the security bar 10 contacts or recesses within the stop 50. In the case of a sliding door when the security bar 10 is affixed to the first door jamb 30 (FIG. 1), the stop 50 may be mounted on the door frame 34 of the second (slidable) door 38. In the case of a sliding door when the security bar 10 is affixed to the door frame 34 of the second (slidable) door 38 (FIG. 5), the stop 50 may be mounted on the first door jamb 30 of the first (fixed) door 36. A stop 50 may also be provided for a hinged door (FIG. 6), for example, on the door 36 itself or on the second door jamb 32. For a window 70 (FIG. 7), the stop 50 may be mounted on the bottom of the upper window sash or the top of the lower window sash, for example. The stop 50 may be of any suitable shape, e.g., substantially rectangular (e.g., a planar top surface), U-shaped, J-shaped, C-shaped, H-shaped, or L-shaped to receive at least a portion of the security bar 10 (e.g., within the recess formed by the U-shape).

The remote-controlled security apparatus may include an additional motor-driven apparatus, such as an actuator, for example, to control the length L of an adjustable security bar 10. In particular, a linear actuator may control the adjustable portion 16 of the adjustable security bar 10 to obtain the desired length L of the security bar 10.

The remote-controlled security apparatus may also include a safety feature. For example, the safety feature may stop the apparatus if an unknown force is applied to the security bar 10 (e.g., a child or object interrupts the expected movement). The apparatus may have a fuse, gear, or the like designed to break or halt any movement of the security bar 10 due to an unexpected condition.

The present invention provides for remote-controlled security apparatuses and systems, which function as a strong visual and physical deterrent to intruders. In addition, the remote control feature allows for hands-free operation of the security bar 10 between locked and unlocked positions from within or outside the building.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges. In addition, features of one embodiment may be incorporated into another embodiment.

What is claimed is:

1. A remote-controlled security apparatus for a door or window having a frame, the remote-controlled security apparatus comprising:

a security bar having a first end hingeably connected to a first portion of the frame of the door or the window and a second end sized to extend substantially across at least a portion of a width or height of the door or the window;

a motor-driven apparatus having a first end and a second end coupled to the security bar; and a remote control which controls the motor-driven apparatus to move the security bar, wherein, when the motor driven apparatus is operated to an unlocked position, the security bar pivots away from a position extending substantially across at least a portion of the width or the height of the door or the window to a rest position adjacent to the first portion of the frame of the door or the window, and wherein, when the motor driven apparatus is operated to a locked position, the security bar pivots to the position extending substantially across at least a portion of the width or the height of the door or window.

2. The security apparatus of claim 1, wherein the security bar is an adjustable-length security bar.

3. The security apparatus of claim 2, wherein the length of the security bar is incrementally adjusted to a length which is less than, the same as, or more than the width or the height of the door or the window.

4. The security apparatus of claim 1, wherein the motor-driven apparatus is a linear actuator.

5. The security apparatus of claim 1, wherein the motor-driven apparatus is removably coupled to the security bar for emergency or manual operation.

6. The security apparatus of claim 1 further comprising at least one lock on the security bar.

7. The security apparatus of claim 1, wherein the locked position comprises the security bar in a substantially horizontal position.

8. The security apparatus of claim 1 further comprising a stop mounted to a third portion of the frame of the door or the window opposite the first portion and adapted to maintain the security bar in a substantially horizontal position when the security bar contacts the stop.

9. The security apparatus of claim 8, wherein the stop comprises a U-, C-, H-, L- or J-shape.

10. The security apparatus of claim 1, wherein the first end of the security bar is connected to a vertical jamb of the door.

11. The security apparatus of claim 10, wherein the first end of the motor-driven apparatus is affixed to the vertical jamb of the door.

12. The security apparatus of claim 1, wherein the door is a sliding door or a hinged door.

13. The security apparatus of claim 1, wherein the security bar is centrally located along the height of the door.

14. The security apparatus of claim 1, wherein the remote-controlled security apparatus is internet-controlled.

15. The security apparatus of claim 1, wherein in the unlocked position, the security bar pivots to the rest position against the first portion of the frame of the door or the window.

16. The security apparatus of claim 1, wherein the motor-driven apparatus is a linear actuator having a 2-12 inch stroke.

17. A security system for securely locking at least one door having first and second parallel vertical door jambs and a width between them, the security system comprising:

a rigid elongated security bar sized to extend substantially horizontally across at least a portion of the width of the door; the security bar hinge-mounted to the first door jamb, and the security bar hinge permitting pivotal motion of the security bar between a substantially vertical position and a substantially horizontal position;

a linear actuator having a first end mounted to the first door jamb and a second end mounted to the security bar proximate the security bar hinge; and a remote control which moves the linear actuator between extended and retracted positions, wherein, when the security bar is in a locked position, the security bar is in the substantially horizontal position and the linear actuator is in a retracted position, and wherein, when the security bar is operated to an unlocked position, the linear actuator extends and pivots the security bar out of the substantially horizontal position to a rest position in the substantially vertical position.

18. The security system of claim 17, wherein the second end of the linear actuator is mounted to the security bar with a hinged mounting bracket comprising a pull pin.

19. The security system of claim 17 further comprising a remote control receiver and a power adapter.

20. The security system of claim 17, wherein a button on the remote control is depressed for a period of time necessary to move the linear actuator between the locked and unlocked positions or between the unlocked and locked positions.

21. The security system of claim 17, wherein the linear actuator comprises a first retracted position when the security bar is in the locked position and the linear actuator is fully retracted and a second extended position when the security bar is in the unlocked position and the linear actuator is fully extended, and wherein a button on the remote control is depressed once to move the linear actuator between the first retracted position and the second extended position or between the second extended position and the first retracted position.

22. The security system of claim 17, wherein the security bar is an adjustable length and the length of the security bar is incrementally controlled by the remote control.

23. A security system for securely locking a pair of sliding doors having a first door and a second door in a sliding door track, the security system comprising:

a rigid elongated security bar sized to extend substantially horizontally across at least a portion of the first door;

a security bar hinge mounting the security bar to a door jamb, the security bar hinge permitting pivotal motion of the security bar between a substantially vertical position and a substantially horizontal position;

a linear actuator having a first end mounted to the door jamb and a second end mounted to the security bar with a hinged-mounting bracket proximate the security bar hinge; and a remote control which moves the linear actuator between extended and retracted positions;

wherein the security bar is in a locked position when the security bar is in the substantially horizontal position, the linear actuator is in a retracted position, and the second door is not able slide in the sliding door track past an end of the security bar; and wherein the security bar is operated to an unlocked position when the linear actuator extends and pivots the security bar out of the substantially horizontal position to a rest position in the substantially vertical position adjacent to the door jamb, and the second door is able to slide in the sliding door track.

* * * * *